US008203064B2

(12) United States Patent
Jeffries et al.

(10) Patent No.: US 8,203,064 B2
(45) Date of Patent: Jun. 19, 2012

(54) ADJUSTABLE FOLDING LEG FOR BASS DRUM

(75) Inventors: Walter B. Jeffries, Cloverdale, OR (US); Tyler D. Hauth, Terrebonne, OR (US)

(73) Assignee: Ego Industries, Inc., Cloverdale, OR (US)

( * ) Notice: Subject to any disclaimer, the term of this patent is extended or adjusted under 35 U.S.C. 154(b) by 0 days.

(21) Appl. No.: 12/901,675

(22) Filed: Oct. 11, 2010

(65) Prior Publication Data

US 2011/0023687 A1 Feb. 3, 2011

Related U.S. Application Data

(62) Division of application No. 12/082,367, filed on Apr. 10, 2008, now Pat. No. 7,834,259.

(51) Int. Cl.
*G10D 13/02* (2006.01)

(52) U.S. Cl. ..... 84/421

(58) Field of Classification Search ..... 84/421
See application file for complete search history.

(56) References Cited

U.S. PATENT DOCUMENTS

| | | | | |
|---|---|---|---|---|
| 2,961,260 | A | 11/1960 | Newlin | |
| 3,396,928 | A | 8/1968 | Lay | |
| 3,737,136 | A | 6/1973 | Snurr | |
| 4,144,822 | A | 3/1979 | Roberts et al. | |
| 4,169,687 | A | 10/1979 | Schull | |
| 4,560,192 | A | 12/1985 | Wilson et al. | |
| 4,732,070 | A | 3/1988 | Yamashita | |
| 5,078,349 | A | 1/1992 | Smith | |
| 5,385,323 | A | 1/1995 | Garelick | |
| 5,408,913 | A | 4/1995 | Hoshino | |
| 6,027,087 | A | 2/2000 | Lindemann et al. | |
| 6,307,135 | B1 | 10/2001 | Hoshino | |
| 6,659,417 | B2 | 12/2003 | Hsieh | |
| 6,763,627 | B1 * | 7/2004 | Kaempe | 42/94 |
| 6,824,319 | B1 | 11/2004 | Speggiorin | |
| 6,843,183 | B2 | 1/2005 | Strong | |
| 6,977,332 | B2 | 12/2005 | Liao | |
| 6,983,950 | B2 | 1/2006 | McCoy et al. | |
| 2005/0189185 | A1 * | 9/2005 | Turner | 188/282.4 |
| 2007/0145202 | A1 | 6/2007 | Hsieh | |

OTHER PUBLICATIONS

Picture of an ASCEND drum with spur from a web page for percussionclinic.com, posted at least as early as Oct. 2007.
Picture of a TAVE drum with spur from a web page for musiciansfriend.com, posted at least as early as Oct. 2007.
Picture of a TAMA drum with spur from a web page for musiciansfriend.com, posted at least as early as Oct. 2007.

(Continued)

*Primary Examiner* — Jianchun Qin
(74) *Attorney, Agent, or Firm* — Chernoff Vilhauer LLP

(57) ABSTRACT

An adjustable, foldable support leg for a bass drum has a cylindrical leg member movable longitudinally within a tubular leg member. A threaded portion of the tubular member includes apertures in which ball bearings are located. The bearings are retained in the apertures by an annular locking collar which is also threaded to allow the collar to move longitudinally on the tubular member as the collar is turned. The locking collar has an interior frustoconical surface. When the collar moves downwardly on the tubular member, this surface presses the ball bearings against the cylindrical member, locking the leg members in place. A mounting bracket includes a pin about which the folding leg pivots and a channel which receives the inner end of the leg. The leg is biased against the floor of the channel which includes detents to receive the end of the leg in the folded and extended positions.

25 Claims, 5 Drawing Sheets

OTHER PUBLICATIONS

Picture of a YAMAHA drum with spur from a web page for musiciansfriend.com, posted at least as early as Oct. 2007.

Picture of a YAMAHA drum with spur from a web page for lexicon.freenet.de/Odaiko, posted at least as early as Oct. 2007.

* cited by examiner

ADJUSTABLE FOLDING LEG FOR BASS DRUM

BACKGROUND OF THE INVENTION

The present invention relates to support legs which are adjustable in length and which are easily folded from a supporting position to a folded position.

Many items, for example drum kits, benefit from a supporting or stabilizing leg which is adjustable in length. The length adjustment mechanism should be both strong to prevent unexpected collapse and comparatively easy to operate. A continuous adjustment is more desirable than one which relies on spaced stops or pre-determined lengths. Common adjustment mechanisms include set screws, fixed stops combined with mechanically interfering latches, and friction fits of various kinds. Preferably, adjusting the length of the leg can be accomplished without the need for tools or manipulation of parts which might become disengaged from the leg.

Exemplary mechanisms for adjusting the length of supporting legs are shown in U.S. Pat. Nos. 3,737,136, 4,169,687, 4,732,070, 6,027,087, 6,824,319, 6,843,183, and 6,977,332.

It is often useful for legs to be movable from an extended supporting position to a folded position convenient for transport or storage. As with length adjustment, the leg must be rigid and held securely in extended position when in use, but should convert easily to the folded position without the need for specialized tools or manipulation of parts which might become disengaged from the leg.

Examples of folding legs are shown in U.S. Pat. Nos. 3,396,928, 4,144,822, 4,560,192, 5,408,913, 6,307,135.

The present invention provides a convenient, secure, continuous, tool-free length adjustment mechanism which is readily adapted to legs of varying sizes. In addition, the leg according to the present invention may be conveniently and quickly swung from an extended position to a folded position with minimal effort, and without sacrificing security when in an extended position. No tools are required to use either feature.

Features and advantages of the present invention will be more readily understood upon consideration of the following detailed description of the invention taken in conjunction with the accompanying drawings.

DETAILED DESCRIPTION OF PREFERRED EMBODIMENT

Figure 1:
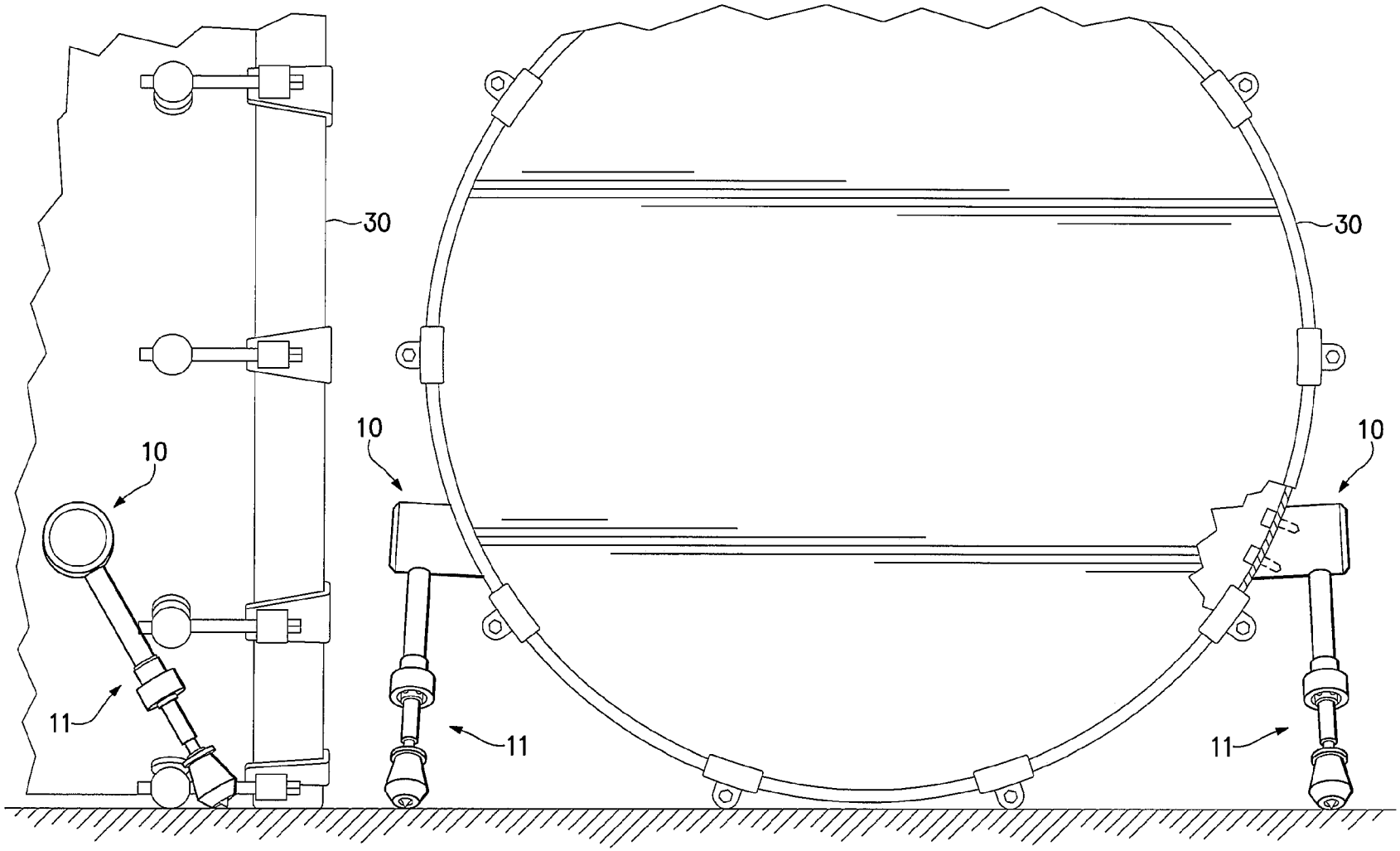
FIG. 1 show partial side and rear elevation views of a base drum having support legs, also called "drum spurs," in the extended positions.
Figures 2, 3, 4:
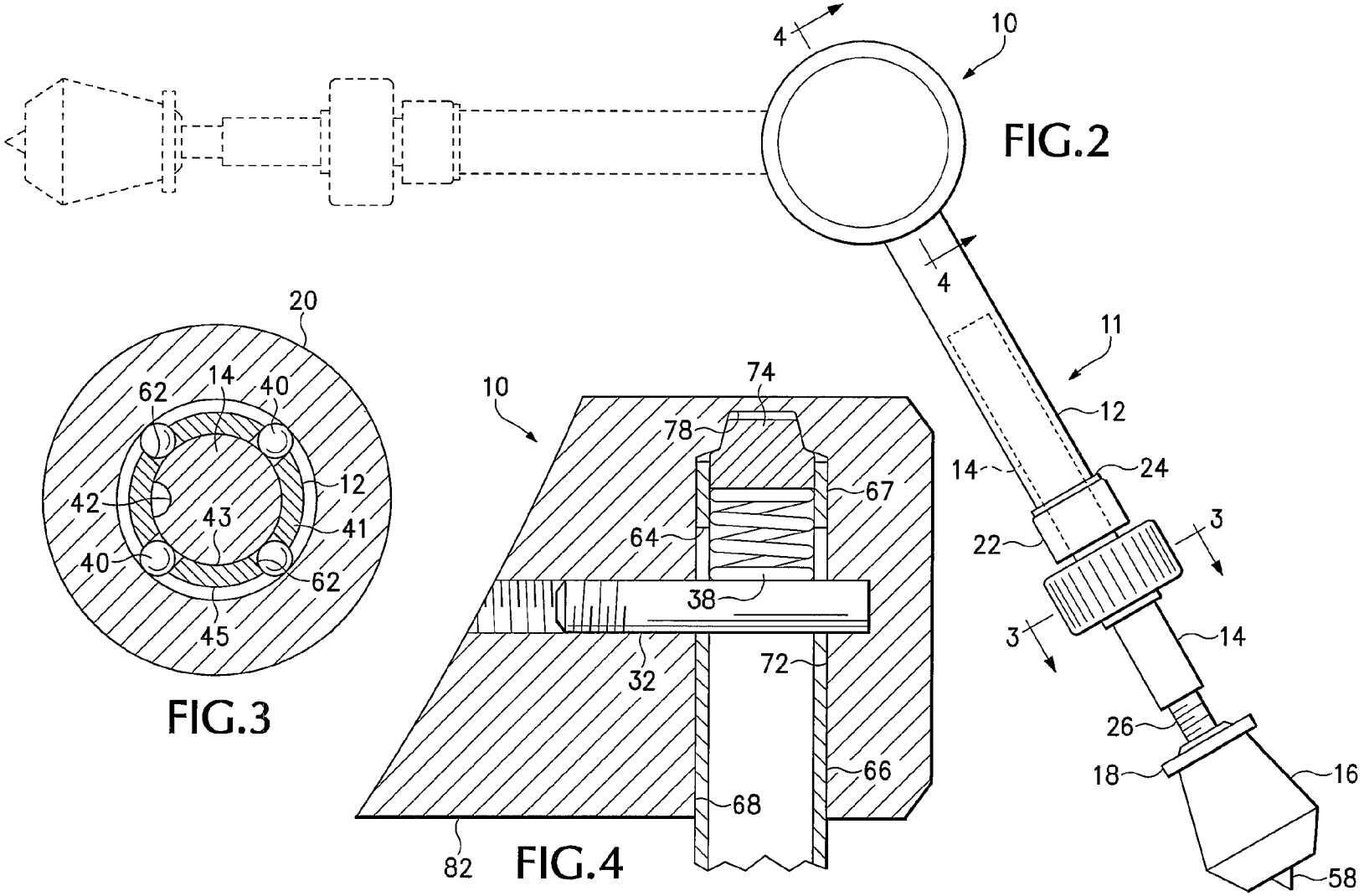
FIG. 2 is a side view showing an exemplary embodiment of a support leg and a mounting bracket, with the leg shown in the extended position in solid lines and in the folded position in dashed lines.
FIG. 3 is a top sectional view of the leg shown in FIG. 2 taken along line 3-3 of FIG. 2.
FIG. 4 is a front sectional view of the base of the leg and the mounting bracket shown in FIG. 2 taken along line 4-4 of FIG. 2.

Referring to the drawings, which are a part of the disclosure herein, FIG. 1 shows an exemplary support leg according to the present invention employed as a "drum spur" to prevent a bass drum from rolling away from the drummer or from sliding backwards when struck by a beater (not shown). The exemplary leg 11 is attached to the bass drum 30 via a mounting bracket 10. FIG. 2 shows the leg 11 and mounting bracket 10 in isolation apart from the drum, and depicts the capability of the leg to be moved from the extended position shown in FIG. 1 to a folded position shown in dashed lines.

Figure 10:
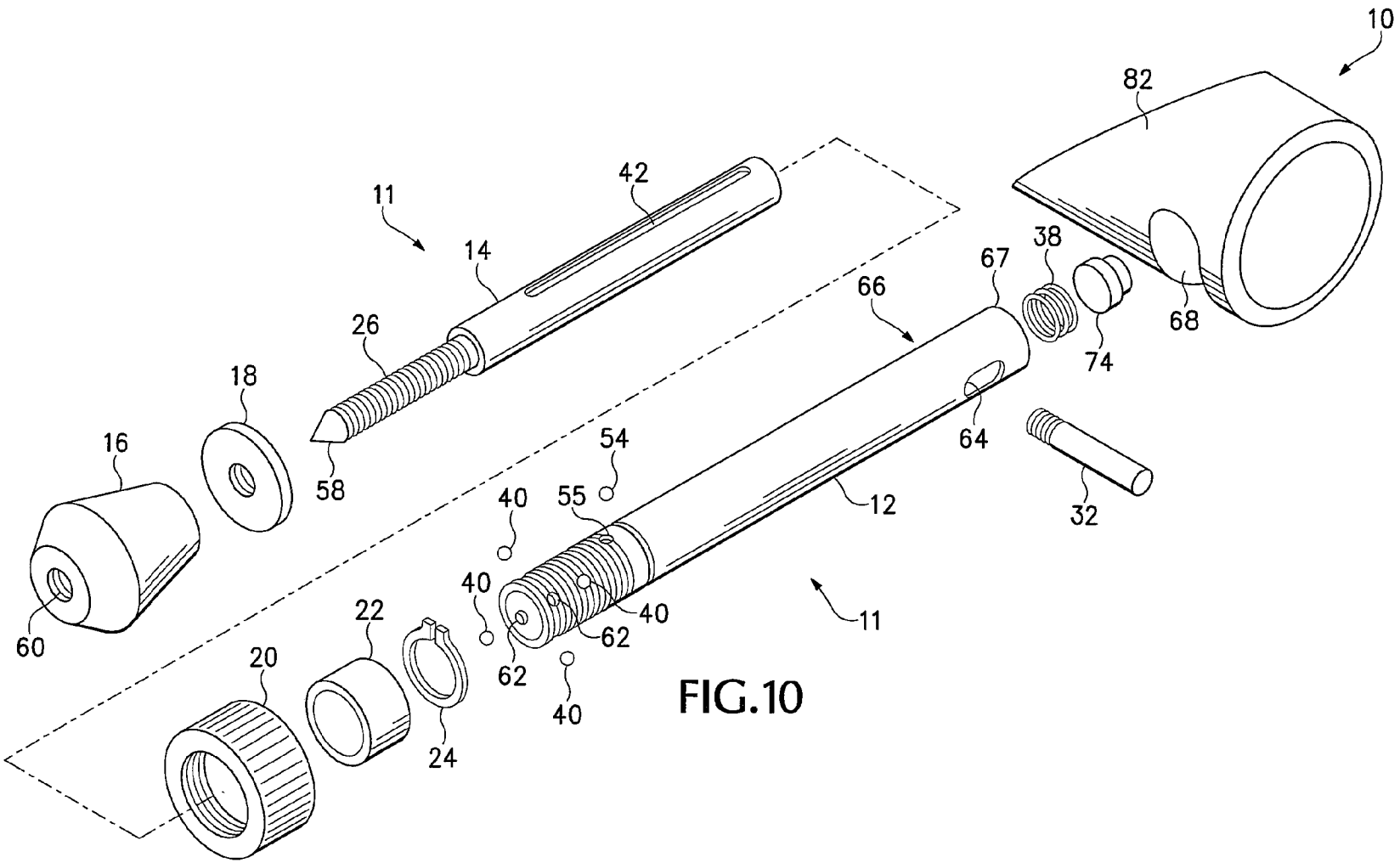
FIG. 10 is an exploded view of the exemplary embodiment of the leg and mounting bracket shown in FIG. 2.

Referring to the exemplary leg shown in FIGS. 1, 2 and 10, the leg 11 includes an upper member 12 proximate the mounting bracket 10 and a lower member 14 distant from the mounting bracket. In the exemplary embodiment, the lower member 14 is elongate and cylindrical in outer form and the upper member 12 is also elongate and is generally tubular with a circular cross section. The inner dimensions of the tubular upper member 12 and the outer dimensions of the cylindrical lower member 14 are sized such that a portion of the lower member 14 may be closely received within the upper member 12. The lower member 14 is movable longitudinally along the elongate axis of the upper member 12 so as to lengthen or shorten the overall length of leg 11.

As shown in FIG. 10, the lower member 14 has a pointed tip 58 to engage textured surfaces such as carpet. A foot 16 is attached to the lower member 14 near its outer end. The foot 16 is composed of a suitable material, such as rubber or soft plastic, to give traction on smooth surfaces. The foot 16 has an opening 60 which permits the pointed tip 58 to contact the floor or other supporting surface without removal of the foot 16. The foot 16 contains inner threads which permits it to engage threads 26 on the outer end of the lower member 14. Rotation of the threaded foot 16 on the threaded portion of the lower member 14 permits the foot to be moved longitudinally on the lower member 14 so as to selectively expose or shield the pointed end 58, depending upon the type of supporting surface. A threaded lock washer 18 may be used to secure the foot 16 in a selected position.

Figure 9:
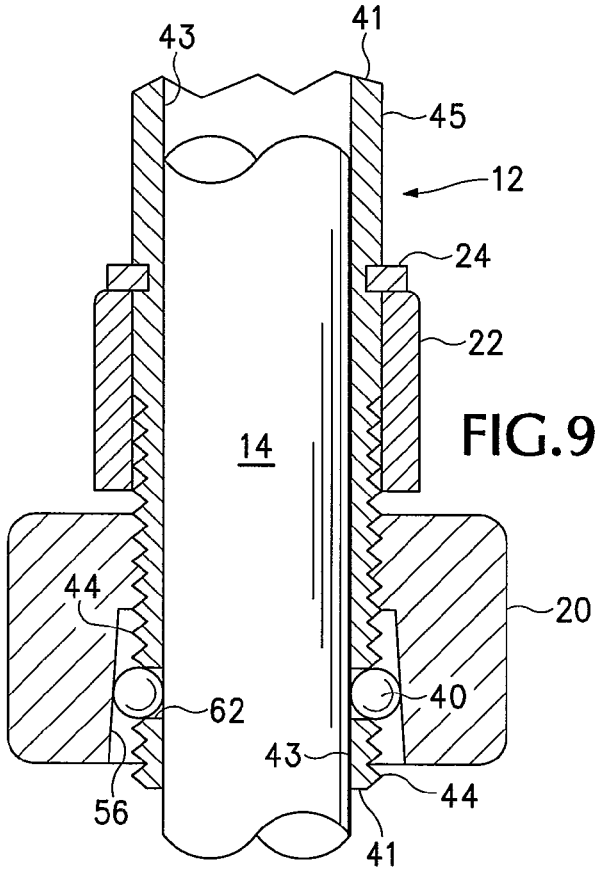
FIG. 9 is a side sectional view of the length-adjusting feature of the leg shown in FIG. 10.

In the exemplary embodiment, the lower member 14 may be securely locked in a selected position with respect to the upper member 12 by the interaction of a clamping collar 20, locking members 40 and apertures 62 in tube wall 41 of the tubular upper member 12. Tube wall 41 has an outer side 45 and an inner side 43. In view of the close fit of the lower member 14 within the upper member 12, the outer surface of the lower member 14 is closely adjacent to the inner side 43 of tube wall 41. A plurality of apertures 62 extend substantially through the tube wall 41 in the region where the lower member 14 and the upper member 12 overlap. A plurality of ball bearings, which serve as independent, or loose, locking members 40 in the exemplary embodiment, are positioned at least partially in the apertures 62. As shown in FIGS. 3 and 9, the diameter of the ball bearing locking members 40 is greater than the width of the tube wall 41. The apertures 62 in tube wall 41 are sufficiently large to permit at least a portion of the locking members 40 to extend beyond the inner side 43 of tube wall and at least partially into the tubular upper member 12. The locking members 40 extend beyond the outer side 45 of tube wall 41. The apertures 62 and locking members 40 are sized such that the locking members 40 are permitted at least some lateral movement in the apertures 62 in a direction substantially perpendicular to the tube wall 41.

The clamping collar 20 is movable longitudinally with respect to the upper member 12 of leg 11. The collar 20 has a frustoconical inner surface 56. As depicted in FIG. 9, this frustoconical inner surface is canted or angled with respect to lowered member 14. Since locking members 40 can extend beyond the inner side 43 and outer side 45 of tube wall 41, the locking members 40 can be in simultaneous contact with the lower member 14 and the clamping collar 20.

In the exemplary embodiment shown in FIG. 9, the collar 20 is moved longitudinally and held in position with respect to upper member 12 by engaging threads 44 on the outer side 45 of the upper member 12. The bore of the collar 20 includes threads that engage the threads 44 on the upper member 12. Rotation of the collar 20 on the threads 44 in one direction moves the collar downwardly, causing the frustoconical inner surface 56 to engage the locking members 40 and presses them inwardly through the apertures 62 into contact with the lower member 14. The outer surface of collar 20 is textured to provide a secure gripping surface. Tightening the collar 20 clamps the collar, lower member 14 and locking members 40 together. The locking members 40 are prevented from longitudinal movement by the upwardly and downwardly facing surfaces at the edges of apertures 62 thereby preventing longitudinal movement of the lower member 14 with respect to the upper member and fixing the overall length of leg 11. To adjust the length of leg 11, the collar 20 may be rotated in the other direction, moving the collar upwardly on the upper member 12, releasing the locking members 40 and permitting them to move slightly outwardly in the apertures 62, thereby removing lateral pressure on the lower member 14 and permitting it to be moved longitudinally with respect to the upper member 12 to lengthen or shorten the leg.

Viewed in two dimensions, the canted surface of the collar 20 exerts a lateral force on locking member 40 which in turn exerts a lateral force on the lower member 14. As the canted surface 56 of the collar 20 moves longitudinally a portion of the canted surface moves laterally into contact with the locking member 40 and creates a lateral force on the locking member 40 and lower member 14. All three components are held in place by the frictional forces caused by the lateral pressure. The edges of the apertures 62 in the tube wall 41 provide a lateral surface to prevent longitudinal movement of the locking members 40 and thereby longitudinal movement of the lower member 14.

In the exemplary embodiment, the lower member 14 includes an elongate keyway 42. The upper member includes a keyhole 55 in the tube wall 41. The key 54—a ball bearing in the exemplary embodiment—extends through the keyhole 55 and into the keyway 42. Once again, the width of the key 54 is greater than the width of the tube wall 41. The key 54 is retained in the keyhole 55 and keyway 42 by a close fitting sleeve 22 encircling the upper member 12. The sleeve 22 prevents key 54 from extending substantially beyond the outer side 45 of tube wall 41 and insures that a portion of the key 54 extends into the keyway 42. The sleeve 22 is held in place between the collar 20 and a resilient clip 24 that is seated in a circumferential groove in the upper member 12. The interaction of the key 54, keyhole 55 and keyway 42 prevent the lower member 14 from rotating with respect to the upper member 12. The ends of the keyway 42 are closed preventing the lower member 14 from sliding out of the upper member 12 and limiting the extent to which the lower member 14 may extend upwardly into the upper member 12. The length of the keyway determines the range of adjustment of the leg 11.

The length adjustment feature described above permits the leg 11 to be lengthened or shortened without any tools or loose parts that can disengage from the leg. The operation may be performed by loosening the clamping collar, extending or retracting the lower member 14 from the upper member 12, and retightening the collar. The length of the leg 11 can be set anywhere within the range of movement of the lower member 14 with respect to the upper member 12.

Although the exemplary embodiment employs a cylindrical lower member 14 which moves within a closely fitting cylindrical tubular upper member 12, other configurations are possible. For example, it is not necessary that one of the members be a tube, and if a tube arrangement is used, it is not necessary that the tube be cylindrical. Of course, it follows that the movable clamping device—a collar 20 with a circular bore in the exemplary embodiment—does not need to be a collar or have a frustoconical surface 56. Further, it is not necessary that the lower member 14 move with respect to the upper member 12, alternatively, the upper member 12 could move with respect to the lower member.

While the exemplary embodiment shows a leg 11 with only one length adjusting feature, an adjustable leg in accordance with the present invention could have multiple adjustable features as described herein.

While the locking members 40 in the exemplary embodiment are independent ball bearings, other devices would also be within the scope of the invention.

The apertures in the exemplary embodiment are shown as round holes, but other passageways or openings which permit movement of a locking member to impinge a movable adjusting member are intended to be within the concept of an "aperture."

The exemplary embodiment uses mating threads to move the clamping member longitudinally with respect to a leg member. The threads provide a retaining surface, substantially transverse to the length-adjusting direction, that may be engaged by a clamping member to prohibit movement of the clamping member in a length-adjusting direction. Other mechanisms or arrangements for moving the clamping mechanism or maintaining it in the locking position are within the scope of this invention.

While the leg members are described herein as elongate, and shown as long slender members, it is only necessary that the leg members be sufficiently long to accommodate the desired range of movement in the length-adjusting direction.

Turning now to the folding aspect of the invention, the exemplary leg 11 shown in FIG. 1 is attached to the drum 30 by mounting bracket 10, which is fastened to the drum by screws extending through the shell of the drum into the mounting bracket 10. In the preferred embodiment, the leg 11 is permitted to move through a predetermined angle between an extended supporting position and a folded position as shown in FIG. 2. Referring to FIGS. 4-7 and 10, a pivot pin 32, substantially centered in the mounting bracket, attaches the upper member 12 of the leg 11 to the mounting bracket 10. The pin 32 defines a pivot axis about which the leg 11 pivots between extended and folded positions.

Figure 5:
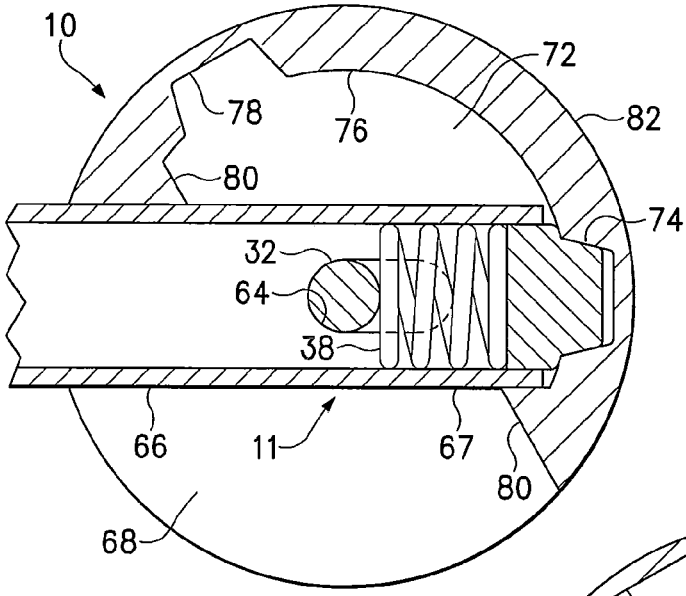
FIGS. 5 and 6 are side sectional views of the mounting bracket and the base of the leg shown in FIG. 2.
Figure 6:
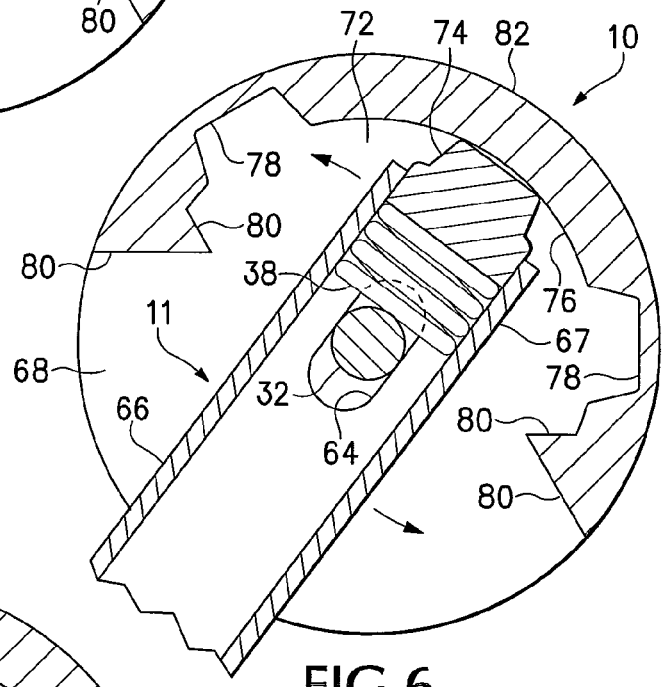
Figure 7:
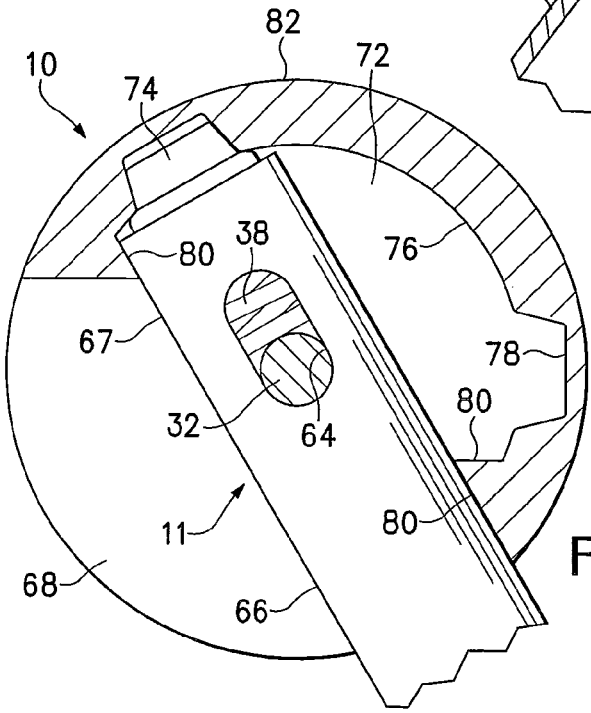
FIG. 7 is a further side view of the mounting bracket and the base of the leg shown in FIG. 2 with the mounting bracket and pivot pin shown in section.

In the exemplary embodiment, the upper member 12 of leg 11 includes a base portion 66 that is received by the mounting bracket 10 and pivotally attached to the pivot pin 32. As shown in FIGS. 5-7, the pivot pin 32 extends through an elongate aperture 64 in the base portion 66. In the exemplary embodiment, the bracket 10 is generally cylindrical. An open mouth 68 is formed in the side wall 82. The side wall 82 opposite the mouth 68 is closed. The mouth 68 appears on the side wall 82 of the bracket as an arcuate, elongate slot. The mouth 68 receives the base portion 66 of leg 11. The length of the elongate mouth 68 defines the rotational limit of travel of the leg 11

The base portion 66 of the leg 11 includes an inner end 67 which is located on the opposite side of the pivot pin 32 from the remainder of the leg 11. As shown in FIGS. 2 and 5-7, as the leg 11 swings through the angle permitted by the mouth 68, the inner end 67 swings through an inner channel 72 in the mounting bracket 10. The angle of travel of the leg 11 is mirrored by the angle of travel of the inner end 67 in the inner channel 72.

In the exemplary embodiment, the inner end 67 includes a tip 74. As the leg 11 pivots about pin 32 between the extended and folded positions, the tip 74 moves along a concave arcuate path which defines the floor 76 of channel 72. The floor 76 of the channel 72 faces the pin 32 and is intersected by a plane defined by the leg 11 as it pivots about the pin. As may be seen in FIGS. 5-7, the channel floor 76 defines an arc whose focus in the pivot pin 32. Floor 76 of channel 72 include recessed detents 78 at each end of the channel 72. The detents 78 are sized and shaped to closely receive the tip 74 of the inner end 67 of leg 11.

In operation, the tip 74 is biased into contact with the channel floor 76 by a spring 38. In one embodiment shown in FIGS. 5-7, a coil spring 38 is positioned within the inner end 67 of leg 11 between the pin 32 and tip 74. When the tip 74 is received within detent 78 as shown in FIGS. 5 and 7, the spring 38 is partially compressed, urging the tip into the detent 78. However, since the slotted aperture 64 in the base portion 66 of leg 11 is elongate in the longitudinal direction of leg, the leg may be drawn back against the force of the spring 38, further compressing the spring and withdrawing the tip 74 from the detent 78. With the tip 74 free of the detent 78, the leg can be pivoted about pin 32 from extended position represented in FIG. 7 to the folded position represented in FIG. 5. In the exemplary embodiment, the detents 78 at either end of the channel 72 correspond to the extended and folded positions. Once the tip 74 is withdrawn from detent 78 and the leg 11 has been pivoted a slight distance, pull on the leg 11 can be released and the leg can be pivoted to the other position. During this maneuver, the spring 38 will bias the tip 74 onto the channel floor 76, but the frictional forces generated by the spring may be readily overcome by the leverage created by the relatively long leg 11 with respect to the length of the inner end 67.

Referring to the sequence shown in FIGS. 5-7, in FIG. 5 the leg is securely held in the folded position. The tip 74 is biased by spring 38 into the detent 78 corresponding to the folded position. The interference between the longitudinal sides of the tip 74 and the walls of the detent 78 prevent the leg 11 from pivoting further about pin 32. Particular note should be taken of the taper of both the tip 74 and the detent 78. The size and taper of both are chosen so that they form a wedging fit. A gap remains between the bottom of detent 78 and the tip 74. This fit ensures that the leg 11 is held firmly, with no play allowable. The leg 11 is positioned such that the pin 32 is adjacent, but not touching, the outer end of the elongate slotted aperture 64 to allow the wedging fit. In order move the leg 11 from the folded position to the extended position it is necessary to pull the leg 11 back away from the mounting bracket 10 against the force of spring 32 sufficiently to permit the tip 74 to move counter-clockwise in the channel 72 as shown in FIG. 6. Note that in this position the spring 38 is further compressed such that the pin 32 is in the middle of slotted aperture 64. In this position the leg does not need to be pulled against the force of the spring 38, but the spring biases the tip 74 against the floor 76 of channel 72. When the inner end 67 of leg 11 reaches the end of channel 72 corresponding to the extended position, the force of spring 38 snaps the tip 74 into detent 78. Longitudinal force on leg 11 caused by supporting the drum or retaining it in place are carried by the leg and further press the tip 74 into the detent 78. Put another way, the force vector of weight on the leg 11 passes directly into the detent. Lateral forces on the leg 11 are countered by the walls of the detent 78. In FIG. 7, the leg 11 is secured in the extended position and environmentally applied forces on the leg tend to increase stability of the leg.

Further support for the leg 11 is provided by the configuration of mouth 68 and inner channel 72 in the mounting bracket 10. As shown in FIGS. 5-7, the inner channel 72 includes end walls 80, and the mouth 68 includes end walls 80, which limit rotation of the leg 11 about pin 32. As shown in FIG. 4, the base portion 66 and inner end 67 of leg 11 are closely received in the channel 72 and mouth 68 and the side walls of the channel 72 and mouth 68 also provide lateral support for the leg 11.

Thus, moving the leg 11 from extended position to folded position, or vice versa, is a simple, quick operation—one simply grasps the leg 11, pulls it away from the mounting bracket and begins to pivot it toward the other position. Thereafter, pulling pressure on the leg 11 may be released, while still moving the leg toward the other position, and when the leg 11 reaches the desired position, the spring 38 will cause the leg to seat itself in the corresponding detent 78. No tools are required and there are no parts that could become disengaged from the leg or drum.

Figure 8:
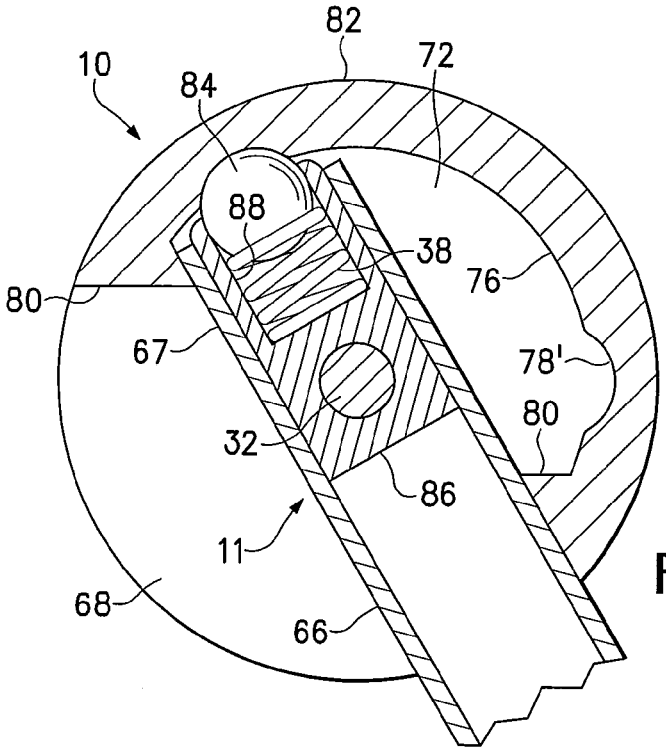
FIG. 8 is a side sectional view of an alternate embodiment of the base of the leg and the mounting bracket.

Turning to an alternate embodiment shown in FIG. 8, a movable tip 84 in the form of a ball bearing is retained in the inner end 67 of the leg 11. While leg 11 is still pivotable about pin 32, the arrangement is different. The aperture in leg 11 is not elongate, but sized to fit the pin 32. Longitudinal movement of leg 11 with respect to pin 32 is prohibited. A bushing 86 is arranged inside the inner end 67 of leg 11. The bushing 86 includes an aperture sized to receive the pin 32. The bushing 86 includes a cavity 88 to receive the spring 38 and a portion of the movable tip 84. The bushing includes provisions to restrain the movable tip 84 from disengaging from the leg. In the embodiment shown in FIG. 8, the movable tip 84 is a ball bearing which is retained by pinching the end of the cavity 88.

The floor 76 of inner channel 72 includes detents 78' at each end of the channel. As explained with respect to FIGS. 5-7, the detents 78' correspond to the extended and folded positions of leg 11. Detents 78' are concave depressions shaped to fit a portion of the spherical outer surface of movable tip 84. Spring 38 urges movable tip 84 into detents 78' when the leg is in extended or folded position. When lateral pressure is applied to leg 11, the sloping surface of the concave detent 78' forces the movable tip 84 back into the cavity 88 against the force of the spring 38. When the leg 11 reaches the other position, the spring 38 urges the movable tip 84 into the appropriate detent 78'. The spring 38 continues to urge the movable tip 84 against the floor 76 of channel 72 as the leg is being moved between positions.

While the exemplary embodiment shows a solid unitary mounting bracket 10 carrying pin 32 with the inner channel 72, channel floor 76, detents 78 and 78', mouth 68 and associated structures formed therein, other arrangements to provide the claimed elements are within the scope of the invention. For example only, the channel floor 76 does not have to be a part of, or directly connected to the mounting bracket 10.

Further, the invention does not require a coil spring, different spring types and spring arrangements are possible and different tips and detents are within the invention as claimed. While the exemplary embodiment shows two detents, additional detents for further leg positions are contemplated.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A folding leg assembly comprising:

a. an elongate supporting leg member having a first end with a tip and a second end, said leg member including at least one aperture between said first and second ends;

b. a mounting bracket interconnecting said leg member with an object to be supported;

c. at least one pivot pin attached to said mounting bracket and received in said aperture of said leg member so as to enable said leg member to pivot about said pin between an extended position and a folded position;

d. an elongate channel associated with said object, said channel having an elongate curved floor which is arcuate in the elongate direction, said tip of said leg member received in said channel, said channel having a first recessed detent in said floor; and e. said tip movable upon said floor between a second position within said channel when said leg member is in said folded position and a first position within said channel when said leg member is in said extended position wherein said tip fits into said first detent in said floor of said channel.

2. The leg assembly of claim 1 wherein said tip of said leg member is biased against said floor of said channel substantially throughout movement of said tip within said channel.

3. The leg assembly of claim 1, including a spring associated with said leg member urging said tip of said leg member toward said floor of said channel.

4. The leg assembly of claim 3 wherein said spring urges said tip into said first detent when said first end is substantially at said first position.

5. The leg assembly of claim 4 wherein said aperture in said leg member is elongate in the longitudinal direction of said leg member permitting said leg member to be moved longitudinally in the direction of said second end against the force of said spring so as to permit said tip to be withdrawn from said first detent.

6. The leg assembly of claim 1 including a spring compressed between said pin and said first end of said leg member, said spring urging said tip away from said pin.

7. The leg assembly of claim 1 wherein said elongate leg member defines a longitudinal axis in the elongate direction and said tip is moveable in a longitudinal direction with respect to said first end.

8. The leg assembly of claim 1 wherein said elongate leg member defines an axis in the elongate direction, said leg member including a spring urging said tip substantially axially against said floor of said channel.

9. The leg assembly of claim 8 wherein said spring is compressed between a portion of said first end and said tip.

10. The leg assembly of claim 1 wherein said elongate leg member defines an axis in its elongate direction and said pin is elongate and defines a separate axis in its elongate direction, and wherein axial force upon said leg in one direction urges said leg toward said floor.

11. The leg assembly of claim 1 wherein said channel includes a first end wall adjacent said first detent.

12. The leg assembly of claim 11 wherein said channel includes opposed side walls, said side walls and said first end wall providing lateral support for said leg member when said tip of said leg member is received in said first detent.

13. The leg assembly of claim 1 wherein said mounting bracket incorporates said channel.

14. The leg assembly of claim 1 wherein said elongate leg member defines a first axis and said pivot pin is elongate defining a second axis substantially perpendicular to said first axis, wherein movement of said tip upon said floor substantially defines an arc whose focus is said pivot pin.

15. The leg assembly of claim 1 wherein said channel includes a second recessed detent in said floor, said second detent corresponding to said second position of said leg.

16. The leg assembly of claim 15 wherein said channel includes a second end wall adjacent said second detent.

17. The leg assembly of claim 1 wherein said channel has at least one side wall providing lateral support to said first end of said leg member.

18. The leg assembly of claim 1 wherein said leg member defines an elongate axis and said tip is biased axially against said floor of said channel substantially throughout movement of said tip within said channel.

19. A folding leg assembly comprising:

a. an elongate supporting leg member having a first end and a second end and including at least one aperture between said first and second ends;

b. a mounting bracket interconnecting said leg member with an object to be supported;

c. at least one pivot pin attached to said mounting bracket and received in said aperture of said leg member so as to enable said leg member to pivot about said pin between an extended position and a folded position; and d. an elongate path, arcuate in the elongate direction, associated with said object, said path defined by movement of said first end as said leg member pivots about said pin between extended and folded positions, said path having a arcuate concave surface facing said pin, said surface defining an arc whose focus is said pivot pin, said first end of said leg member moving on said surface as said leg member pivots about said pin, said path including a first recessed detent in said surface.

20. The leg assembly of claim 19 wherein said first end is movable upon said surface between a second position when said leg member is in said folded position and a first position wherein said leg member is in said extended position and said first end is received in said first detent.

21. The leg assembly of claim 19 wherein said pivoting movement of said leg defines a plane, said elongate path lying substantially within said plane.

22. The leg assembly of claim 19 wherein said mounting bracket includes said path.

23. The leg assembly of claim 19 wherein said elongate leg defines an elongate axis, said axis passing through said path substantially throughout movement of leg member between extended and folded positions.

24. The leg of claim 23 wherein axial force on said leg in one direction is borne by said path.

25. The leg assembly of claim 19 wherein said first end of said elongate leg member is biased along its longitudinal axis toward said path.

* * * * *